US006551066B2

(12) United States Patent
Saylor et al.

(10) Patent No.: US 6,551,066 B2
(45) Date of Patent: Apr. 22, 2003

(54) HIGH PRESSURE PORTABLE AIR COMPRESSOR

(75) Inventors: Gary D. Saylor, Hollsople, PA (US); Brian E. King, Johnstown, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/041,181

(22) Filed: Jan. 8, 2002

(65) Prior Publication Data

US 2002/0124559 A1 Sep. 12, 2002

Related U.S. Application Data

(60) Provisional application No. 60/262,304, filed on Jan. 12, 2001.

(51) Int. Cl.[7] ..... F04B 49/06
(52) U.S. Cl. ..... 417/44.2; 417/234; 417/502
(58) Field of Search ..... 417/44.2, 364, 417/234, 307, 502

(56) References Cited

U.S. PATENT DOCUMENTS 2,267,479 A * 12/1941 Sturm et al. ..... 417/307
4,829,625 A 5/1989 Wang
5,125,800 A * 6/1992 Wong ..... 417/44
5,147,182 A * 9/1992 Timmons ..... 417/234
5,396,885 A 3/1995 Nelson
5,636,971 A * 6/1997 Renedo Puig et al. ..... 417/44.2
5,809,999 A 9/1998 Lang
5,858,062 A 1/1999 McCulloh
6,065,942 A * 5/2000 Glidden et al. ..... 417/234
6,119,475 A 9/2000 Murray et al.
6,146,101 A * 11/2000 Chang ..... 417/42

OTHER PUBLICATIONS

MAX Fastening brochure, p. 22, dated Nov., 1999.

* cited by examiner

*Primary Examiner*—Cheryl J. Tyler
(74) *Attorney, Agent, or Firm*—Harness, Dickey & Pierce, P.L.C.

(57) ABSTRACT

A portable air compressor includes a frame, a motor mounted to the frame, a storage tank coupled to the frame and a compression mechanism in communication with the storage tank. The motor drivingly engages the compression mechanism. The compressor includes a first regulator coupled to the storage tank for defining a first pressure at a first outlet port. A second regulator is coupled to the storage tank for defining a second pressure output at a second outlet port.

14 Claims, 4 Drawing Sheets

HIGH PRESSURE PORTABLE AIR COMPRESSOR

CROSS-REFERENCE TO RELATED APPLICATIONS

This application claims the benefit of U.S. Provisional Application No. 60/262,304, filed Jan. 12, 2001.

BACKGROUND OF THE INVENTION

1. Technical Field

The present invention relates generally to air compressors and, more particularly, to a portable air compressor having individual high and low pressure output ports.

2. Discussion

Construction workers and other professionals often times have a need for a portable compressed air source. Specifically, workers within the rough construction industry have found certain tools such as air nailers and air staple guns useful in their trade. To operate these devices in the field, a portable source of compressed air is required. Additionally, it should be appreciated that many construction sites do not include a source of electrical power. Accordingly, a portable air compressor with its own source of compressing power is preferred.

In the past, portable air compressors have been equipped with at least one storage tank having a pressure switch to define the pressure within the tank and a regulator to limit the pressure released at an output port or ports. Typically, the operating range of the output pressure regulator is from 0 to 200 PSI. This corresponds to the operating range of standard air nailers and air staple guns.

Recently, a new line of pneumatic hand tools has been introduced. Some air nailers and staple guns now operate at a pressure of approximately 425 PSI. Designers of these new tools have been able to drastically decrease the size and weight of the air nailers using the higher operating pressure. As would be expected, workers in the field prefer lighter weight, less cumbersome tools if performance is not sacrificed.

However, many existing air tools currently require regulated pressures ranging from 35 TO 90 PSI. Such devices include paint spray guns and impact wrenches. Accordingly, a need exists for a portable air compressor having a low pressure output port and a high pressure output port.

DETAILED DESCRIPTION OF THE PREFERRED EMBODIMENT

Figure 1:
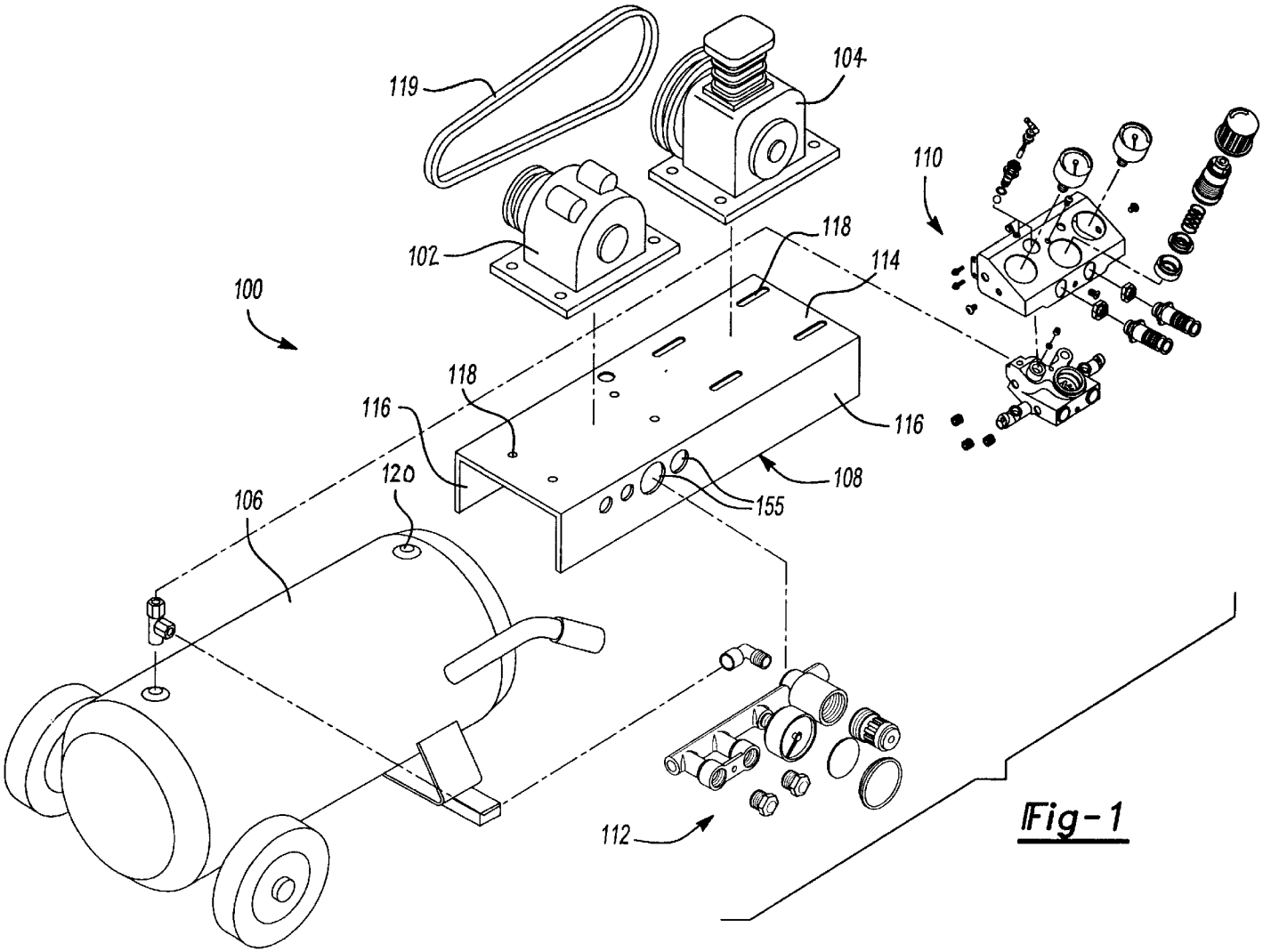
FIG. 1 is an exploded perspective view of a high pressure portable air compressor constructed in accordance with the teachings of the present invention.

With reference to the figures, a high pressure portable air compressor constructed in accordance with the teachings of the present invention is generally depicted at reference numeral 100. Air compressor 100 includes a motor 102, a compressor 104, a storage tank 106, a deck 108, a first panel assembly 110 and a second panel assembly 112. Deck 108 is coupled to storage tank 106 and includes mounting provisions for motor 102 and compressor 104.

Deck 108 is a generally "U" shaped member having a mounting plate portion 114 positioned between a pair of downwardly extending side walls 116. Mounting plate portion 114 includes a plurality of apertures 118 for receipt of fasteners (not shown) used to couple motor 102 and compressor 104 to deck 108. Once mounted to deck 108, motor 102 is drivingly coupled to compressor 104 via a belt 119. During operation, rotation of motor 102 causes rotation of compressor 104 thereby initiating a supply of compressed air to an intake port 120 located on storage tank 106. It should be appreciated that motor 102 may be an electrically powered AC or DC motor, an internal combustion engine or any other suitable power generating device.

Figure 2:
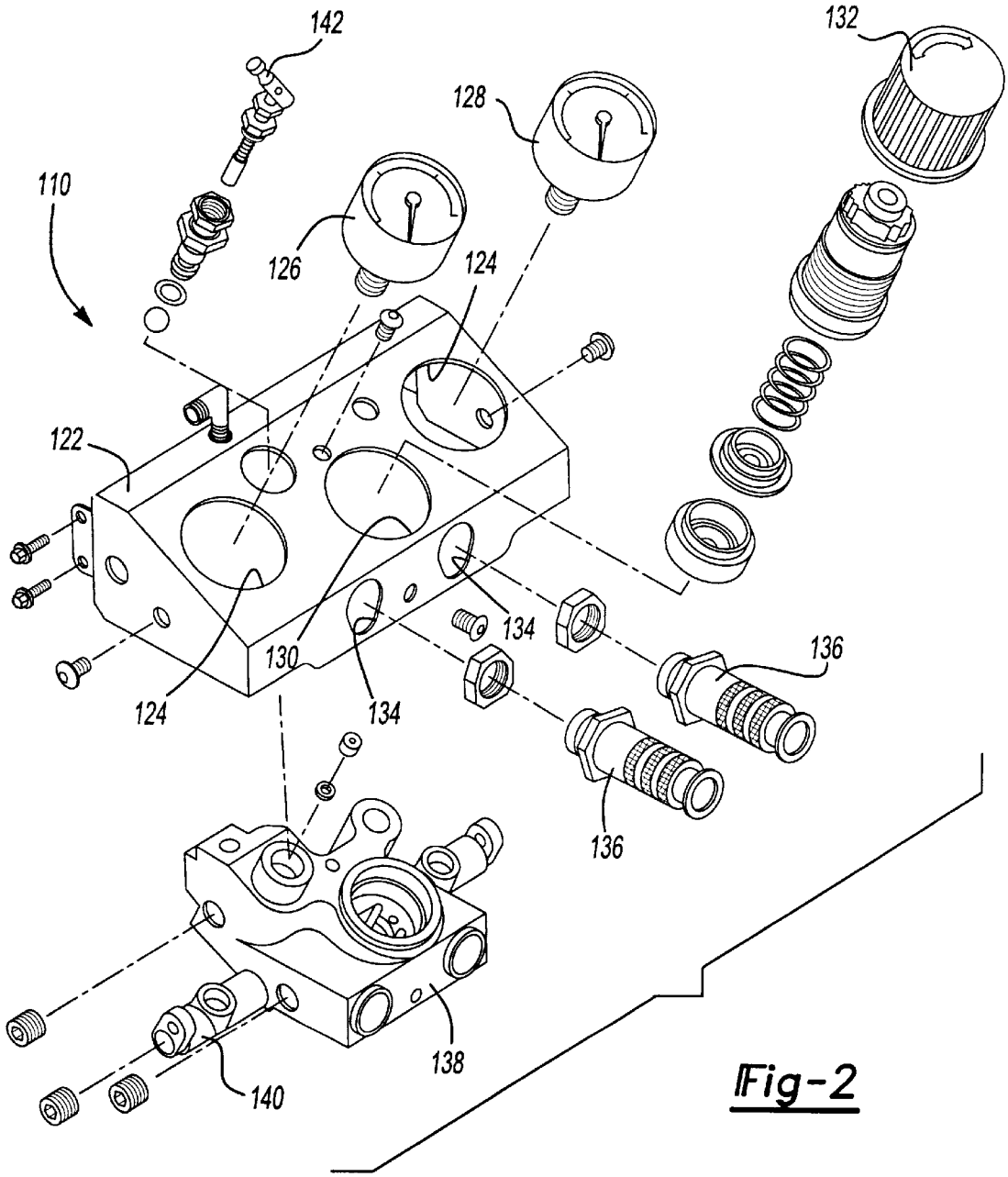
FIG. 2 is a partial exploded perspective view of a first panel assembly of the present invention.

With reference to FIG. 2, first panel assembly 110 includes a panel 122 coupled to deck 108. Panel 122 includes a pair of apertures 124 for receipt of a first gage 126 and a second gage 128. Panel 122 further includes an aperture 130 for receipt of a pressure regulator assembly 132. A pair of apertures 134 are each adapted to receive a quick coupler 136. Each quick coupler 136 is a normally closed valve which opens upon interconnection with a mating hose coupler (not shown). Each quick coupler 136 includes a right-hand NPT thread at one end and an automotive type quick connect fitting at the opposite end. Each quick coupler 136 is coupled to a manifold 138 downstream of regulator 132. Therefore, the output pressure from each quick coupler 136 substantially matches the regulated air pressure.

Manifold 138 includes an input 140 receiving pressurized air directly from storage tank 106. First gage 126 directly receives air stored in storage tank 106 as well. Accordingly, first gage 126 displays storage tank internal pressure. Second gage 128 is also plumbed to manifold 138 but receives regulated pressure downstream of regulator 132. As such, second gage 128 displays the pressure output from regulator 132. A pressure relief valve (not shown) is coupled to manifold 138 to assure that only relatively low pressure is available to quick coupler 136.

A pilot valve 142 is also coupled to panel 122 and manifold 138. Pilot valve 142 is useful to vent compressed air to atmosphere once the target tank pressure is met. It should be appreciated that pilot valve 142 may be alternatively coupled directly to tank 106. Pilot valve 142 is typically used only when compressor 100 is equipped with an internal combustion motor to allow the internal combustion motor to operate in a constant-run mode. If an electric motor is used, compressor 100 operates in start-stop mode where a pressure limit switch shuts off the motor once the desired tank pressure is reached.

A dual control system may also be used in conjunction with an electric motor. The dual control system includes a pressure limit switch and a pilot valve. With dual control, a user may select to operate the compressor in the start-stop mode or the constant-run mode to conserve electricity.

Figure 3:
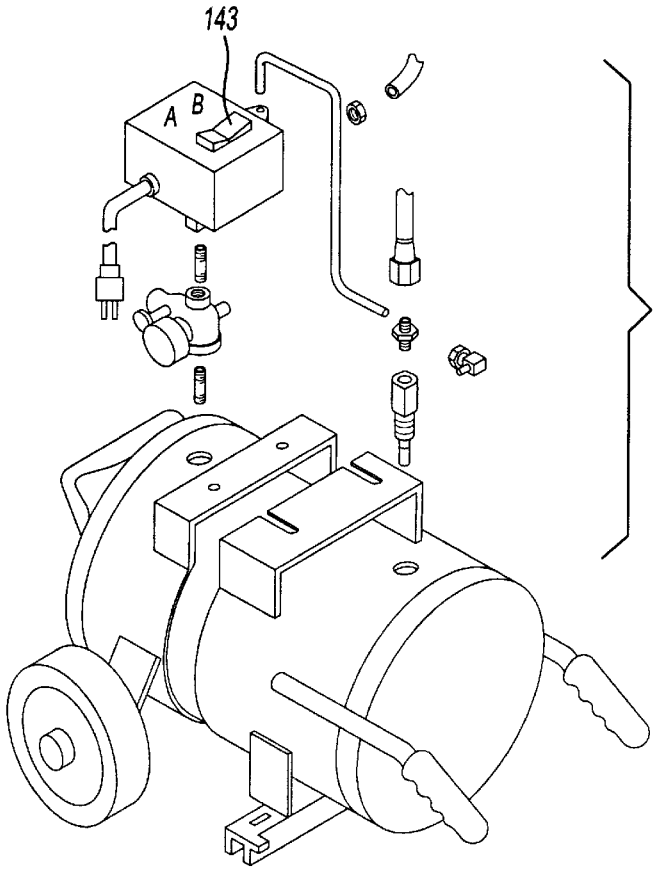
FIG. 3 is a partial exploded perspective view of an alternative embodiment compressor including a dual pressure limit switch.

In the embodiment depicted in FIG. 3, a dual pressure limit switch 143 is included to allow a user to select a desired maximum tank pressure. If a maximum pressure of 200 PSI is desired, the user simply moves switch 143 to position A. If high pressure tools are to be used, the user moves switch 143 to position B thereby directing motor 102 to compress air until approximately 425 PSI is generated. Therefore, air is compressed to the full 425 PSI only when necessary to avoid undue motor and compressor loading.

Figure 4:
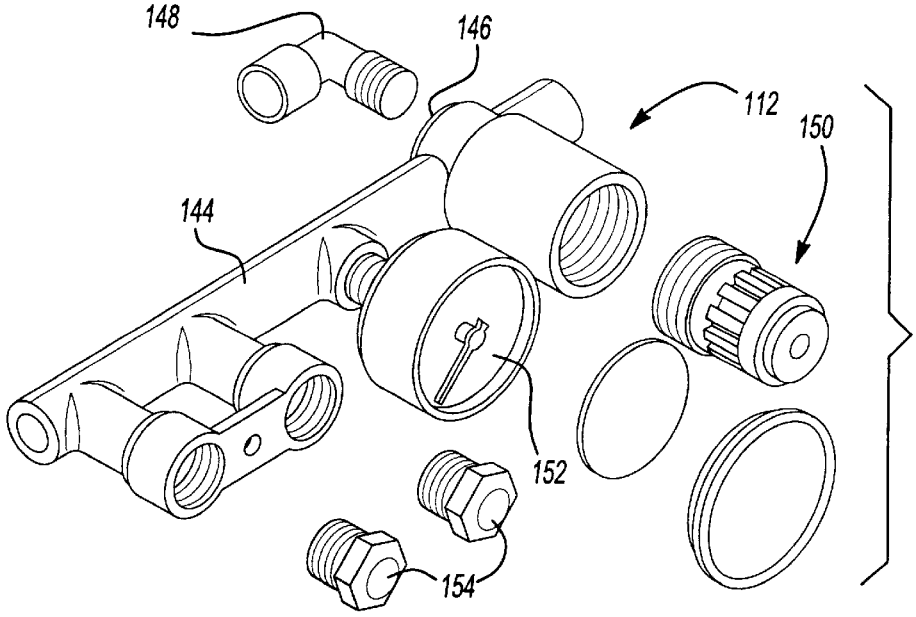
FIG. 4 is a partial exploded perspective view of a second panel assembly of the present invention.

With reference to FIG. 4, second panel assembly 112 includes a manifold 144 having an input 146 in communication with the interior volume of storage tank 106. A burst hose 148 is plumbed between manifold 144 and storage tank 106 to prevent gross over-pressure situations. Specifically, burst hose 148 is designed to provide a pressure relief for tank 106 when internal pressure is greater than approximately 900 PSI.

Second panel assembly 112 includes a regulator assembly 150, a gage 152 and a pair of high pressure quick couplers 154. Gage 152 is positioned downstream of regulator 150 and displays the regulated output pressure. It should be appreciated that second panel assembly 112 is preferably a high pressure panel assembly. As such, pressure gage 152 is capable of measuring pressures up to 450 PSI or greater, if so desired. First gage 126 is therefore the low pressure gage and includes a dial face indicating that pressures from 0–200 PSI are available.

With reference to FIG. 1, deck 108 includes a plurality of apertures 155 for receipt of pressure regulator 150, pressure gage 152 and quick couplers 154. Each quick coupler 154 includes left-hand NPT threads and preferably includes quick connect fittings of a smaller size than quick couplers 136 to assure that a user connects to the appropriate air pressure source. Manifold 144 is coupled to deck 108 and preferably positioned between the deck and storage tank 106. In this manner, the high pressure fitting interconnections are not easily disturbed.

Figure 5:
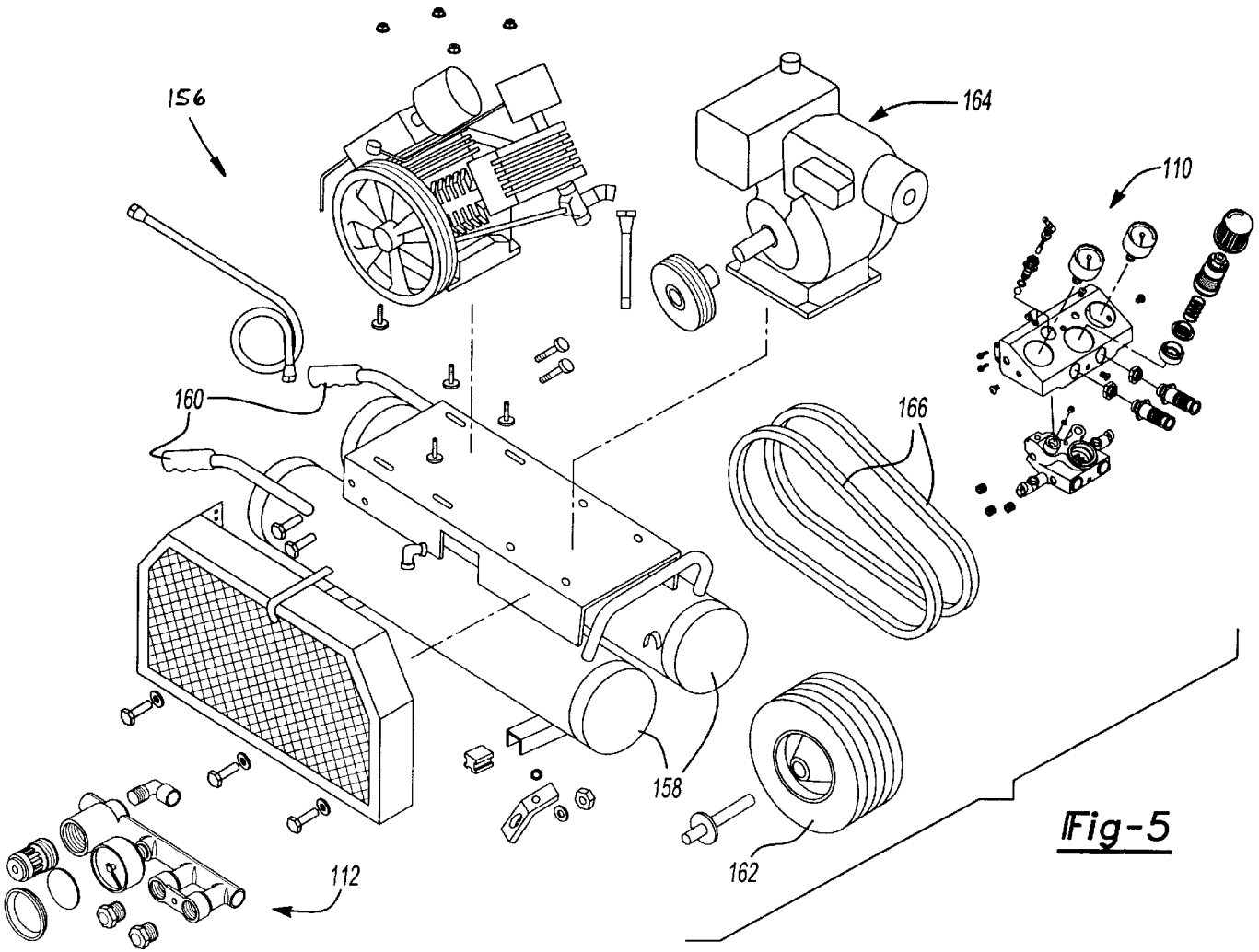
FIG. 5 is an exploded perspective view of an alternative compressor embodiment.

A second embodiment high pressure air compressor 156 having alternative tank, deck and motor configurations is depicted in FIG. 5. Air compressor 156 includes a pair of tanks 158 positioned adjacent one another to provide a low-profile assembly. Tanks 158 are plumbed in communication with one another and are charged to the same pressure. Handles 160 are coupled to the tank to assist a user when transporting the air compressor. A wheel 162 is rotatably coupled to tanks 158 to further facilitate movement of the unit. An internal combustion engine 164 is used to drive compressor 104 via drive belts 166. One skilled in the art will appreciate that a high pressure portable air compressor may be constructed using some or all of the exemplary components depicted in FIG. 5 without departing from the scope of the present invention. The foregoing discussion discloses and describes merely exemplary embodiments of the present invention.

One skilled in the art will readily recognize from such discussion, and from the accompanying drawings and claims, that various changes, modifications and variations may be made therein without department from the spirit and scope of the invention as defined in the following claims:

1. A portable air compressor comprising:

a deck;

a motor mounted to said deck;

a storage tank coupled to said deck;

a compression mechanism in communication with said storage tank, said compression mechanism drivingly engaged by said motor;

a first regulator coupled to said storage tank, said first regulator defining a first range of pressures at a first outlet port; and a second regulator coupled to said storage tank, said second regulator defining a second range of pressures at a second outlet port, wherein the maximum pressure of said second range of pressures is substantially greater than the maximum pressure of said first range of pressures.

2. The portable air compressor of claim 1 further including a control mechanism for selectively charging said storage tank to one of a first tank pressure and a second tank pressure.

3. The portable air compressor of claim 2 wherein said second tank pressure is substantially greater than said first tank pressure.

4. The portable air compressor of claim 1 further including a second storage tank plumbed in communication with said storage tank wherein the pressure within each of said tanks is substantially the same.

5. The portable air compressor of claim 1 wherein said motor and said compression mechanism are mounted on a first side of said deck, wherein said storage tank is mounted on an opposing side of said deck and wherein said second regulator is positioned between said storage tank and said deck.

6. The portable air compressor of claim 5 wherein said deck includes a mounting portion and a pair of side walls extending downwardly therefrom, said mounting portion including a plurality of apertures for mounting said motor, wherein at least one of said side walls includes an aperture, and wherein a portion of said second regulator protrudes through said side wall aperture.

7. The portable air compressor of claim 1 further including a first gage coupled to said storage tank for measuring tank pressure, a second gage coupled to said first regulator for measuring pressure downstream from said first regulator and a third gage coupled to said second regulator for measuring pressure downstream from said second regulator.

8. The portable air compressor of claim 1 wherein said motor is an internal combustion engine.

9. The portable air compressor of claim 8 further including a valve coupled to said storage tank wherein said valve opens to vent compressed air to atmosphere once a predetermined tank pressure is met.

10. The portable air compressor of claim 1 further including a wheel rotatably coupled to one of said storage tank and said deck.

11. A portable air compressor comprising:

a frame;

a motor coupled to said frame;

a storage tank coupled to said frame;

a compressor for supplying compressed fluid to said storage tank, said motor drivingly engaging said compressor;

a first pressure regulator coupled to said storage tank, said first pressure regulator defining a first pressure at a first outlet port; and a second pressure regulator coupled to said storage tank, said second pressure regulator defining a second pressure at a second outlet port.

12. The air compressor of claim 11 wherein said first pressure regulator limits said first pressure to a value less than or equal to a predetermined magnitude and wherein said second pressure regulator selectively defines said second pressure to exceed said predetermined magnitude.

13. The air compressor of claim 12 wherein said predetermined magnitude is approximately 200 PSI.

14. The air compressor of claim 11 wherein the maximum value of said second pressure is substantially greater than the maximum value of said first pressure.

* * * * *